United States Patent [19]

Burnstein et al.

[11] 4,328,486

[45] May 4, 1982

[54] ELECTRIC HORN WITH IMPROVED STRIKER ASSEMBLY

[75] Inventors: Philip J. Burnstein, Skokie; Gerard Seyler, Elgin, both of Ill.

[73] Assignee: Pittway Corporation, Aurora, Ill.

[21] Appl. No.: 195,602

[22] Filed: Oct. 9, 1980

[51] Int. Cl.[3] ..... G08B 3/10

[52] U.S. Cl. ..... 340/388; 340/392

[58] Field of Search ..... 340/388, 389, 390, 391, 340/402, 392; 179/115 R, 115 A, 119 R, 119 A, 181 R

[56] References Cited

U.S. PATENT DOCUMENTS

| | | | |
|---|---|---|---|
| 1,211,768 | 1/1917 | Schwarzmann et al. | 340/388 |
| 1,267,418 | 5/1918 | Kaisling | 340/388 |
| 3,530,463 | 9/1970 | Spadini et al. | 340/402 X |
| 4,075,627 | 2/1978 | Pariza | 340/388 |

*Primary Examiner*—John W. Caldwell, Sr.
*Assistant Examiner*—Daniel Myer
*Attorney, Agent, or Firm*—Dithmar, Stotland, Stratman & Levy

[57] ABSTRACT

A horn includes a magnetically permeable housing having a diaphragm attached thereto and an electromagnet also attached to the housing. A carrier member loosely and unattachedly rests on a shelf in the housing and is attached to a striker member of magnetically permeable material. The striker member is located between the diaphragm and the electromagnet and is moved away from and against the diaphragm to generate noise.

7 Claims, 7 Drawing Figures

FIG. 1
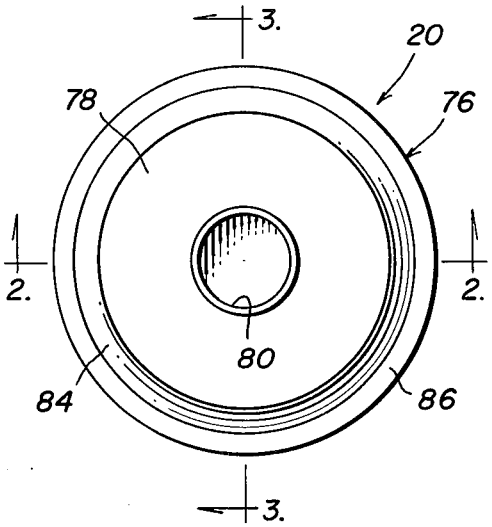
FIG. 2
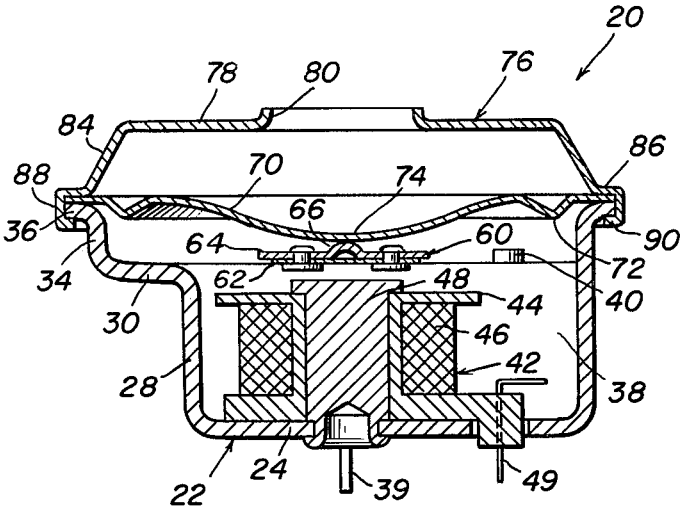
FIG. 3
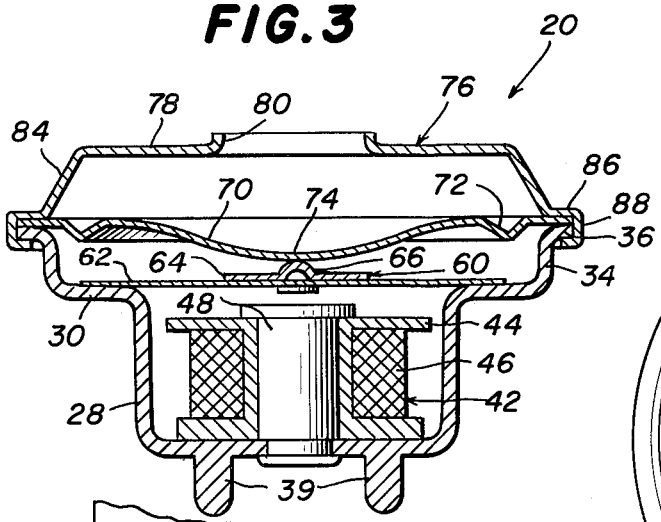
FIG. 4
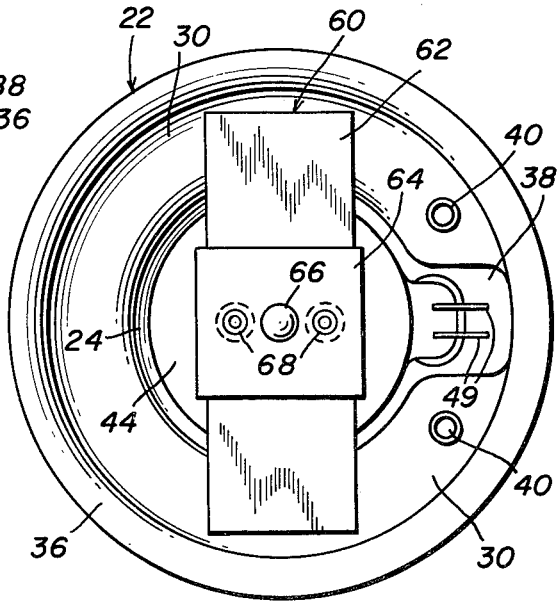
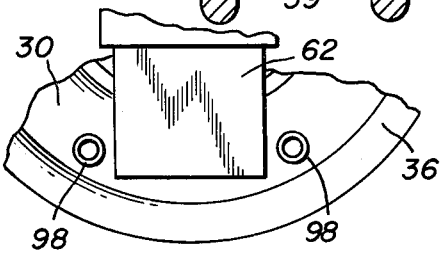
FIG. 7
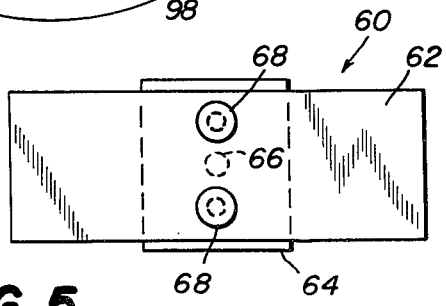
FIG. 5
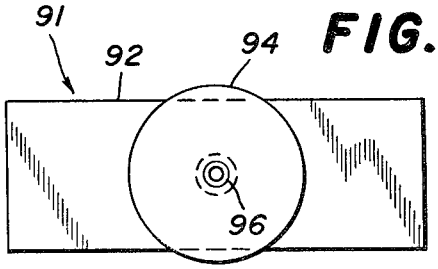
FIG. 6

ELECTRIC HORN WITH IMPROVED STRIKER ASSEMBLY

BACKGROUND OF THE INVENTION

U.S. Pat. No. 4,075,627 assigned to the assignee of the present application discloses an electric horn comprising a housing, an electromagnet, a diaphragm and a striker disposed between the diaphragm and the electromagnet which is mounted by means of a spring to the housing. By so fixing the striker, the horn is more expensive to make, and in certain instances, not as reliable.

SUMMARY OF THE INVENTION

It is, therefore, an important object of the present invention to provide an improved electric horn which is less expensive to manufacture and has improved reliability.

Another object is to provide an electric horn in which the striker is not fixed to the housing but rather is permitted to float.

In summary, there is provided an improved horn for generating an audible signal comprising a housing formed of magnetically permeable material and being open at one end thereof, a diaphragm of relatively flexible material at the one end and attached to the housing, an electromagnet in the housing and attached thereto, a shelf in the housing defining a plane disposed between the diaphragm and the electromagnet, a carrier member loosely resting on the shelf and being unattached thereto, and a striker member of magnetically permeable material mounted on the carrier member, the striker member being located between the diaphragm and the coil and being operatively associated with the coil for movement away from and striking against the diaphragm to generate noise.

Further features of the invention pertain to the particular arrangement of the parts of the electric horn, whereby the above-outlined and additional operating features thereof are attained.

The invention, both as to its organization and method of operation, together with further objects and advantages thereof will best be understood by reference to the following specification taken in connection with the accompanying drawings.

BRIEF DESCRIPTION OF THE DRAWINGS

FIG. 1 is a top plan view of an electric horn incorporating the features of the present invention;

FIG. 2 is an enlarged view in vertical section taken along the line 2—2 of FIG. 1;

FIG. 3 is an enlarged view in vertical section taken along the line 3—3 of FIG. 1;

FIG. 4 is a top plan view of the electric horn with the cover and the diaphragm removed;

FIG. 5 is a bottom plan view of the striker assembly;

FIG. 6 is a top plan view of another embodiment of the striker assembly; and FIG. 7 is a fragmentary view showing the housing and striker assembly representing another embodiment of the present invention.

DETAILED DESCRIPTION OF THE PREFERRED EMBODIMENTS

The drawings illustrate an electrically operated horn 20 embodying the principles of the present invention. Such horn may be used as an audible alarm wherever such alarms are required, but because of its compact and efficient structure, it is particularly suited for use as an audible alarm or sound generator within a fire/smoke detector (not shown). The horn 20 includes a cup-shaped housing 22 formed of magnetically permeable metal. The housing 22 has a circular base 24, a generally cylindrical lower section 28 on the periphery of the base 24, a shelf 30 extending radially outwardly from the upper end of the section 28, a cylindrical upper section 34 of larger diameter than the section 28, and a radially outwardly extending annular lip 36. The shelf 30 carries a pair of upstanding lugs 40 located on either side of the channel 38. Depending from the base 24 are two mounting tabs 39 which are adapted to fit within matching slots in a printed circuit board with which the horn 20 is used. The tabs 39 are bent over and soldered to secure the horn 20 in place.

The horn 20 further comprises an electromagnet 42 positioned in the lower section 28 of the housing 22. The electromagnet 42 includes a bobbin 44, a winding 46, and a core 48 of magnetic material located in the bobbin 44. The outer end of the core 48 is staked or rolled over the exterior surface of the base 24 to secure the electromagnet 42 within the housing 22. In the right-hand region, as viewed in FIG. 2, the section 28 is not offset from, but instead is a continuation, of the section 34, thereby creating a channel 38. An extension of the bobbin 44 is located in the channel 38. A pair of L-shaped terminals 49 is mounted on such extension having ends that protrude from the housing 22 for electrical connection to the printed circuit board with which the horn 20 is used.

The electric horn 20 further comprises a striker assembly 60 which in turn includes a rectangular, elongated carrier 62 preferably constructed of clock steel. Its length and width are such that it will rest on the shelf 30 and will be spaced slightly from the inner surface of the upper section 34. During operation, the striker assembly 60 tends to rotate. The lugs 40 prevent the assembly from falling into the channel 38. The striker assembly 60 further includes a planar striker 64 of a magnetically permeable material having a dimple 66 and being attached to the carrier 62 by means of a pair of laterally spaced-apart rivets 68 on either side of the dimple 66. The magnetically permeable housing 22, and the striker 64 cooperate in defining an efficient media for magnetic flux.

A diaphragm 70 of flexible material, preferably metal, and having a diameter approximately equal to the outer diameter of the lip 36, is circumferentially supported thereon. The diaphragm 70 is formed with a downwardly extending annular ridge 72 spaced from the periphery thereof and a downwardly displaced, central portion 74 which normally engages the striker 64. To this end, it should be noted that the carrier 62 normally urges the striker 64 against the central portion 74.

The diaphragm 70 is held over the housing 22 against the lip 36 by a frusto-conical cover 76. The cover 76 includes a circular top 78 having a circular sound-exit port 80 in the center thereof. A side wall 84 extends downwardly and outwardly from the circumference of the top 78 to an annular lip 86. A flange 88 extends downwardly from the lip 86 and terminates in a plurality of spaced-apart tabs 90.

To operate the horn 20, a source of voltage which may be AC or periodic DC, is connected across the windings 46 by way of terminals 49. A field of magnetic flux is thereby repetitively and intermittently generated through the magnetically permeable media of the coil core 48, the housing 22 and the striker 64, to draw the striker 64 away from the diaphragm 70 against the urging of the carrier 62, and then to release the striker 64 for movement toward and impact against the portion 74 of the diaphragm 70 under the urging of the carrier 62. With each impact of the striker 64 against the diaphragm 70, a sharp sound is generated for exit externally of the horn 20 both directly through the sound-exit port 80 and through the vibration of horn surfaces.

A second embodiment of the striker assembly is shown in FIG. 6. The striker assembly 91 includes a carrier 92 identical in construction to the carrier 62, and a striker 94 which is round and is riveted at 96 to the carrier 92.

A second embodiment for limiting rotation of the striker assembly 60 is depicted in FIG. 7. Here, a pair of lugs 98 is carried by the shelf 30 on opposite sides of the carrier 62. As the striker 64 is caused to vibrate to produce the sound, the lugs 98 prevent undesired rotation in a manner similar to that provided by the lugs 40.

While certain embodiments of the invention have been described, it is to be understood that various other embodiments and other modifications thereof may be devised by one skilled in the art without departing from the spirit and scope of the invention, as defined by the appended claims.

We claim:

1. An improved horn for generating an audible signal comprising a housing formed of magnetically permeable material and being open at one end thereof, a diaphragm of relatively flexible material at said one end and attached to said housing, an electromagnet in said housing and attached thereto, a shelf in said housing defining a plane disposed between said diaphragm and said electromagnet, a carrier member loosely resting on said shelf and being unattached thereto, and a striker member of magnetically permeable material mounted on said carrier member, said striker member being located between said diaphragm and said electromagnet and being operatively associated with said electromagnet for movement away from and striking against said diaphragm to generate noise.

2. The improved horn of claim 1, wherein said shelf is integral with said housing.

3. The improved horn of claim 1, and further comprising at least two lugs on said shelf to limit lateral movement of said carrier member therebetween.

4. The improved horn of claim 1, wherein said striker member is riveted to said carrier member.

5. The improved horn of claim 1, wherein said striker member carries a dimple substantially centrally thereof for striking said diaphragm.

6. The improved horn of claim 1, wherein said striker member is attached to said carrier member by means of a pair of spaced-apart rivets, said striker member including a dimple between said rivets.

7. The improved horn of claim 1, wherein said shelf is ring shaped, said carrier having a middle portion and having two end portions, said end portions respectively resting on diametrically opposite areas of said shelf, said striker member being attached to said middle portion so as to be located in a region not occupied by said shelf.

* * * * *